US005515892A

United States Patent [19]

Najafi et al.

[11] Patent Number: 5,515,892

[45] Date of Patent: May 14, 1996

[54] ECOLOGICAL FUNNEL

[76] Inventors: Afshin Najafi, 16 Waterside Cr., San Rafael, Calif. 94903; Ramin Najafi, 2206 Cecilia St., San Francisco, Calif. 94116

[21] Appl. No.: 389,095

[22] Filed: Feb. 15, 1995

[51] Int. Cl.[6] ..... B65B 43/42; B67C 3/00

[52] U.S. Cl. ..... 141/331; 141/199; 141/338; 141/340; 141/344; 141/363; 141/364

[58] Field of Search ..... 141/199, 297, 141/298, 379, 384, 331–345, 363, 364, 340; 222/460, 461, 462; 73/294; 128/201.11

[56] References Cited

U.S. PATENT DOCUMENTS

| | | | |
|---|---|---|---|
| 606,927 | 7/1898 | Keene | 141/344 |
| 647,111 | 4/1900 | Paradis | 141/335 |
| 1,938,138 | 12/1933 | Downs | 141/339 |
| 1,992,187 | 2/1935 | Carvalho | 141/335 |
| 3,123,106 | 3/1964 | Parhaniemi | 141/336 |
| 4,803,946 | 2/1989 | Ravishankar | 118/152 |
| 5,033,520 | 7/1991 | Kuchmichel | 141/231 |
| 5,195,567 | 3/1993 | Tyree, Jr. | 141/340 |

FOREIGN PATENT DOCUMENTS

| | | | |
|---|---|---|---|
| 0318633A2 | 4/1988 | European Pat. Off. . | |
| 0582126A1 | 7/1993 | European Pat. Off. . | |
| 1076750 | 10/1954 | France | 141/335 |
| 3936099A1 | 2/1991 | Germany . | |
| 510084 | 12/1956 | Italy | 141/331 |
| 93186 | 11/1938 | Sweden | 141/331 |

OTHER PUBLICATIONS

1994 Scienceware Catalog, VWR Seientific, West Chester, PA, pp. 18 & 38.

*Primary Examiner*—Henry J. Recla
*Assistant Examiner*—Timothy L. Maust
*Attorney, Agent, or Firm*—David Pressman

[57] ABSTRACT

A funnel (20) for use in dumping volatile solvents into an underlying carboy (16) is ecologically friendly in that it blocks solvent from evaporating from the carboy into the atmosphere. The funnel has (a) an extended stem (22), the bottom open end of which is below the surface of the solvent (18) in the carboy to reduce surface evaporation, (b) an occluder or obturating ball (24) in the throat of the funnel to block evaporation through the stem of the funnel, and (c) a lid (28) on the funnel to block evaporation. The ball may be float operated, with or without a captivating cage (26), or it may be operated by lifting the lid, which may be performed manually or via a foot pedal (38).

3 Claims, 5 Drawing Sheets

ECOLOGICAL FUNNEL

BACKGROUND—FIELD OF INVENTION

This invention relates generally to funnels, specifically to a funnel which prevents the emission of ecologically and/or environmentally harmful vapors from its underlying container.

PRIOR ART

Laboratories and other facilities which use volatile chemicals, such as benzene and other solvents and diluents, usually have frequent needs to dispose of quantities of such chemicals. E.g., a laboratory may use benzene to clean labware, dichloromethane (methylene chloride) to elute an impurity from a substance, or simply may have waste from a chemical or biochemical reaction. After use, these solvents are contaminated and thus must be disposed. Such facilities usually effected such disposals by providing a container or carboy, e.g., of polypropylene or glass. A worker removed the cap of the carboy, inserted and left a funnel in the stem of the carboy, and dumped contaminated or unneeded quantities of solvents into the funnel and hence the carboy below the funnel. After the personnel filled the carboy, they reinstalled its cap and then shipped the sealed carboy to an approved disposal, recycling, or incineration facility.

This system has a serious disadvantage: the solvent in the carboy was exposed and open to the atmosphere via the stem funnel which passed through the stem of the carboy. Thus the volatile solvent evaporated into and contaminated the atmosphere via the patent lumen of such stem. Since it usually took days or weeks to fill the carboy with solvent, a considerable amount of solvent evaporated to the atmosphere over the extended period of time. Even if the carboy were recapped in the evenings, when personnel did not use it, a considerable amount of solvent still was able to evaporate to the atmosphere during diurnal times when the cap was removed, the funnel was installed, and the patent path was present.

At first blush, it may seem that the contamination of the atmosphere from by such evaporation is not great enough to be important or significant. However, tests have proved the reverse. E.g., with an 8-liter carboy filled with dichloromethane, 500 ml. (0.665 kg.) of this solvent evaporated into the atmosphere via the stem of the funnel in 114 hours (4.75 days). One study (Brian Bateman, Bay Area Air Quality Management District (BAAQMD), Laboratory Building Fume Hood Modeling Study, 1994 September) has shown that each 25,000 square feet of laboratory space releases enough volatile solvents into its atmosphere to cause one person per million in the San Francisco Bay Area to contract some form of cancer. In addition, the atmospheric contamination has other deleterious effects, such as smog, haze, unbluing of the sky, asthmatic effects, destruction of the protective ozone layer, etc.

Of course this evaporation and contamination problem and its concomitant deleterious effects can be virtually entirely alleviated by not leaving funnels with their patent stems in carboys. However to do this, each carboy would have to be kept capped at all times (except during dumping of solvent), and personnel would have to remove the cap, insert the funnel, and remove the funnel and recap the carboy each time they dumped solvent. Experience has shown that laboratory personnel will be simply too languorous to perform these operations each time they dump solvent. Instead they will tend to leave the carboy open with the funnel inserted at all times, thereby seriously contaminating the atmosphere through solvent evaporation.

Ravishankar, in U.S. Pat. No. 4,803,946 (1989), shows a funnel with a long drain stem which extends into the liquid solvent in the collection tank below the funnel. This results in reduced buildup of solvent on the walls of the tank. However the top of the funnel is still left exposed, so that solvent can evaporate through the stem of the funnel into the atmosphere, thereby contaminating it as aforedescribed.

U.S. Pat. No. 5,033,520 to Kuehmichel (1991) shows a large metal drum with a top funnel having an offset stem which is inserted into a bung opening in the top of the drum. Solvent can evaporate into the atmosphere via such stem, which is patent. The drum has a top cover, but this must be removed with the funnel is installed.

Offenlegungschrift DE 39 36 099 A1 to Kuehmichel (published 1991) shows a drum with a long-stemmed funnel which extends into the liquid in the drum. This arrangement suffers from the same disadvantages as aforedescribed.

Europäische Patentanmeldung 0 582 126 A1 to Recycling-Chemie-Niederrhein (published 1993) shows a similar arrangement with the same disadvantages.

A laboratories supplies catalog from Scienceware by VWR Scientific, West Chester, Pa. (1994) shows, on pp. 18 and 38, funnels with caps which are hinged to the upper rim of the funnel. The caps can be held stably in either the open (vertically upright) or closed position. This cap will not prevent the evaporation-contamination problem because it cannot perfectly seal the funnel. Moreover personnel will tend to leave it in the open position after use, thereby losing any benefit the cap could provide. Further I have found that the fluid has a large surface area from which the solvent evaporates, creating a large amount of vapor in the top of the carboy which the cap on the funnel cannot contain effectively.

OBJECTS AND ADVANTAGES

Accordingly, several objects and advantages of the invention are to eliminate atmospheric contamination from evaporated solvents, to preclude the need for personnel using funnels to dispose of solvents to recap such funnels after use, to provide an ecologically friendly funnel, and to reduce the incidence of cancer and other deleterious effects (smog, haze, unbluing of the sky, asthmatic effects, destruction of the protective ozone layer, etc.) from solvent evaporation.

Another object is to make the job of the laboratory worker easier by eliminating the need to touch the funnel and recap the carboy after each use.

Further objects and advantages will become apparent from a consideration of the ensuing description and the accompanying drawings.

DRAWING FIGURES

DRAWING REFERENCE NUMERALS

Drawing Reference Numerals

| | | | |
|---|---|---|---|
| 10 | funnel | 12 | body of 10 |
| 14 | stem of 10 | 16 | carboy |
| 16n | neck of carboy | 17 | closure for apparatus |
| 18 | solvent | 20 | funnel |
| 22 | stem | 24 | obturating ball |
| 26 | captivating cage | 28 | lid |
| 28a | arm | 28b | tab |
| 30 | bracket | 30a | tab |
| 30h | hole | 32 | decanter |
| 34 | obturating ball | 36 | link |
| 36s | stop on 36 | 38 | foot pedal |
| 40 | link | 42 | hinge pin |
| 42s | spring | 42t | timer |

SUMMARY

In accordance with the invention, an ecological funnel prevents backflow of solvent vapors. It has (a) an extended stem, the bottom open end of which is below the surface of the solvent in the receiving container to reduce surface evaporation, (b) an occluder ball in the throat of the funnel to block evaporation through the stem of the funnel, (c) a lid on the funnel to block evaporation, and (d) a sealed closure for the apparatus which creates a tight fit between the stem and the carboy to prevent any flow of evaporated solvent around such stem. The ball may be float operated, with or without a captivating cage, or it may be operated by lifting of the lid, which may be performed manually or via a foot pedal.

Figure 1:
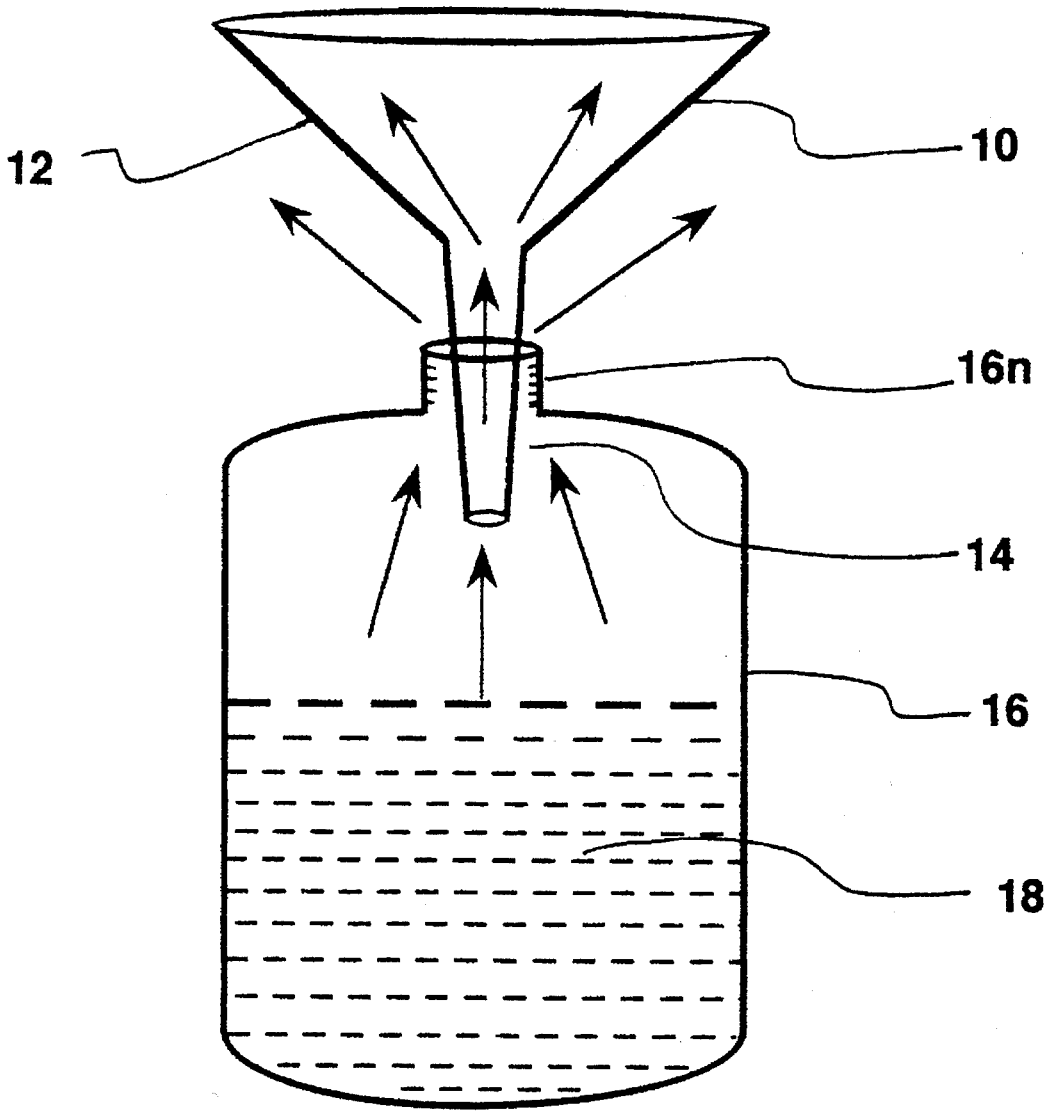
Fig. 1 Prior Art
FIG. 1 is a view, partially in cross section, of a prior-art carboy and funnel.

Description And Operation—FIG. 1—Prior-Art Funnel With Carboy

FIG. 1 shows a prior-art funnel 10 having a body 12 and a stem 14 inserted into a neck **16*n* of a conventional carboy 16 which contains a quantity of solvent 18. Solvent 18 is being collected for disposal, recycling, incineration, or any other purpose. Funnel 10 is shown in perspective, while carboy 16 is shown in section for clarity. Funnel 10 and carboy 16 are usually made of polyethylene, polypropylene, nylon, glass, or stainless steel. Carboy 16 usually has a capacity of 10 to 100 liters and funnel 10** usually has a top diameter of 20 to 250 cm, a height of 20 to 80 cm, and a stem outer diameter of 22 to 35 mm.

At irregular intervals, personnel in a laboratory or other facility will dump or empty quantities of solvent from beakers or other containers into the open upper end of body 12 of funnel 10 so that the solvent will flow by gravity through stem 14 into carboy 18, When the personnel eventually fill the carboy, they will remove the funnel, recap the carboy, and ship it for disposal, recycling, etc.

The disadvantages of the system of FIG. 1 are described supra. To iterate, solvent 18 evaporates from its surface, which has a relatively large area. The solvent vapor flows upward via (a) the lumen of stem 14 and body 12, and (b) the annular space between the inside of neck **16*n* and around stem 14. The solvent vapor then contaminates the immediate environment and the general atmosphere. Such evaporation can be reduced by providing funnel 10 with a hinged cap; such capped funnels are commercially available. However this is difficult to do as a practical matter because laboratory personnel will be too languid to recap the funnel after each dump. Also, even when capped, solvent will still evaporate through the cap's seal, which is not hermetic. The amount of solvent evaporating can be significant and quite harmful, as indicated supra, and will depend upon the volatility of the solvent, the size of the carboy, and the inner diameter of stem 14**. With modem increases in the use of solvents for semiconductors, medicine, plastics, etc., and increasing human density and overpopulation of the planet, we believe the problem of contamination of the atmosphere is significant and severe and a major factor of cancers, asthma, and other diseases.

Figure 2A:
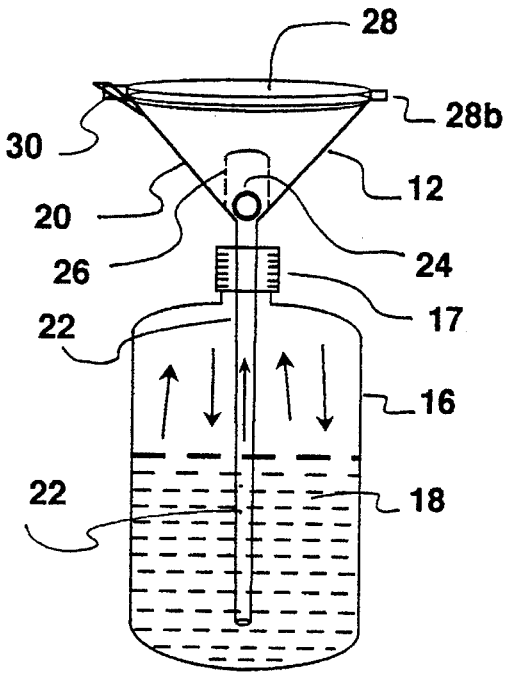
FIGS. 2A and 2B are views, partially in cross section, of the carboy with an ecological funnel having a captivated occluder ball, in occluding and transmissive conditions, in accordance with the invention.
Figure 2B:
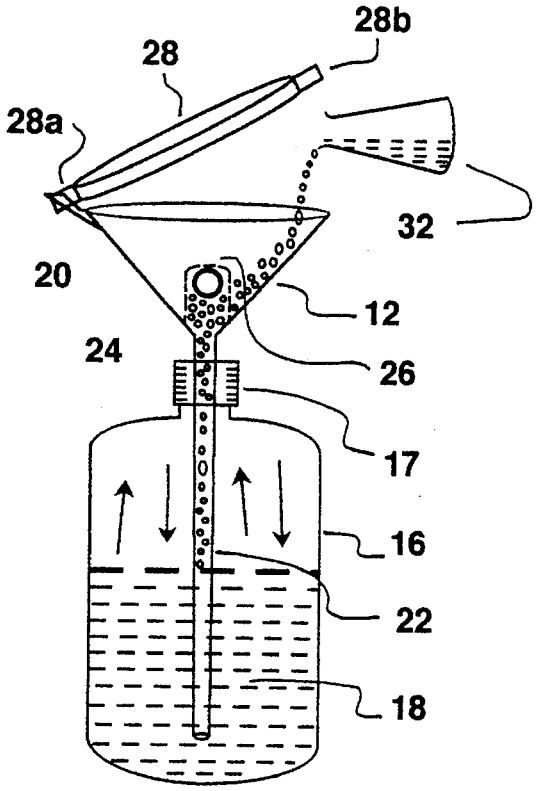

Description—FIGS. 2A and 2B—Funnel With Long Stem And Obturating Ball

In accordance with a basic embodiment of the invention as shown in FIGS. 2A and 2B, a funnel 20 has a long tapered stem 22 which extends below the surface of solvent 18. Body 20 of funnel 20 has a tapering, conical, conventional shape. Funnel 20 and carboy 16 may be of the same size and material of the prior-art funnel of FIG. 1, except that it has a longer stem 22 which extends almost to the bottom of the carboy, preferably about one cm. from the bottom.

An obturating ball 24 is positioned in body 12 of funnel 20. The diameter of ball 24 is such that it will occlude the throat opening at the base or bottom of body 12 where such body joins and communicates with stem 22. E.g., if stem 22 has a maximum inner diameter of 20 mm at its upper end, ball 24 should have a slightly larger diameter, i.e., 22 mm. Ball 24 should be made of a material which is chemically resistant to the solvent(s) to be dumped into the carboy. E.g., high density polyethylene and polypropylene and resistant to most solvents. A ball of either of these materials can be made hollow, rendering it less dense (e.g., density 0.7 g/ml) than most hydrocarbon solvents (density 0.75 g/ml) or halogenated hydrocarbon solvents (density 1.3 g/ml). Thus the ball will float on such solvents.

Ball 24 is surrounded by a captivating cage 26. Cage 26 is optional can should be ignored temporarily to understand the present embodiment, which does not employ the cage.

Body 12 of funnel 20 has a lid 28 which is hingedly connected to a bracket 30 by a short arm **28*a*. Bracket 30 is in turn connected to body 12 and is shown in more detail in FIG. 5. The right side of bracket 30 is fixedly joined to body 12 and the left end is hingedly connected to arm 28*a* of lid 28. Lid 28, when closed covers and seals the upper opening or mouth of body 12 as indicated in FIG. 2A, but can be manually lifted by a graspable extension tab 28*b* to open the top of the funnel so that liquid can be poured thereinto from a decanter or beaker 32, as shown in FIG. 2B**.

Stem 22 of the funnel is attached to a closure cap 17 which is provided to seal the space between the outside of stem 22 and the inside of the carboy's neck. Cap 17 is like a conventional, internally threaded carboy cap, except that it has a hole (not shown) through the center of its top; this hole is plastic-welded to the outside of stem 22 so that closure 17 and funnel 20 are made integral. The funnel is thus attached to the carboy by inserting stem 22 into the carboy and then screwing closure 17 onto the carboy's neck.

Operation—FIGS. 2A and 2B—Without Cage

Ignoring captivating cage 26 temporarily, normally ball 24 sits in the throat opening of body 12 (the top of the lumen of stem 22) and seals such opening to prevent backflow of vapors of solvent 18 from traveling upwardly via such throat. Since stem 22 of the funnel is submerged in solvent 18, the large surface area of the solvent, from which a great amount of solvent will tend to evaporate, is effectively sealed from the lumen of stem 22 and thus cannot escape via such lumen. The annular space between the outside of stem 22 and the inside of the neck of the carboy is obturated by closure 17. Thus vapors from the surface of solvent 18 will stay in the upper portion of carboy 16, as indicated by the recirculating arrows. Solvent from the very small surface of solvent 18 within stem 22 will be blocked from escaping by ball 24, as stated. As an added protective measure, any solvent that does escape past ball 24 (its seal is imperfect) will be blocked by closed lid 28. Thus when the assembly of FIG. 2A is in its normal closed state, as indicated in FIG. 2A, virtually no solvent will escape by evaporation. Lid 28 is desirable but optional.

When a lab worker desires to dump some solvent into carboy 16, the worker will lift lid 28 as indicated in FIG. 2B and pour in the solvent from a decanter 32, as also indicated. The solvent will flow by gravity to the ball-sealed throat of body 12 of the funnel. Since ball 12 is less dense than the solvent, the ball will float on the solvent as indicated, allowing the solvent to flow past the ball and down stem 22 into the carboy. When all of the solvent flows past ball 26, ball 26 will settle to its normally obturating position in the throat of the funnel to reseat such throat as shown in FIG. 2A to prevent the escape of solvent by evaporation. Also, after emptying the solvent, the worker will return lid 28 to its closed position, as also shown in FIG. 2A, to provide a further safeguard.

Thus the operation of obturating ball 24 is automatic: it opens the throat when solvent is poured into the funnel and it automatically reseals the throat when the solvent has all flowed into the carboy. Thus the funnel of FIGS. 2 is ecologically friendly in that it prevents the escape of solvents automatically.

The arrangement of FIG. 2 was tested with the 8-liter carboy as aforementioned filled with dichloromethane. As stated, without the ball, lid, and long stem on the funnel, 500 ml. (0.665 kg.) of this solvent evaporated into the atmosphere via the stem of the funnel and the annular space therearound in 114 hours (4.75 days). With the ball, lid, and long stem, no measurable amount of solvent was lost during the same period. This result presented dramatic evidence of the efficacy of the funnel of the invention and its usefulness in reducing atmospheric contamination and its concomitant deleterious effects.

Operation—FIGS. 2A and 2B—With Cage

Preferably cage 26 is also used to captivate ball 24 so that the ball will not be lost if the funnel is removed and upended, or if solvent is dumped into the funnel so fast that it will tend to wash the ball out of the funnel. Cage 26 preferably is circular when seen from the top, has an inside diameter which is about 2 or 3 mm wider than the diameter of ball 24, has an internal height about twice that of ball 24, and is made of polypropylene, polyethylene, or nylon with numerous openings, preferably of a circular shape, covering at least 50% of its surface to allow solvent to flow therethrough. The base of cage 26 is cemented to the body of the funnel or is molded therewith.

Figure 3A:
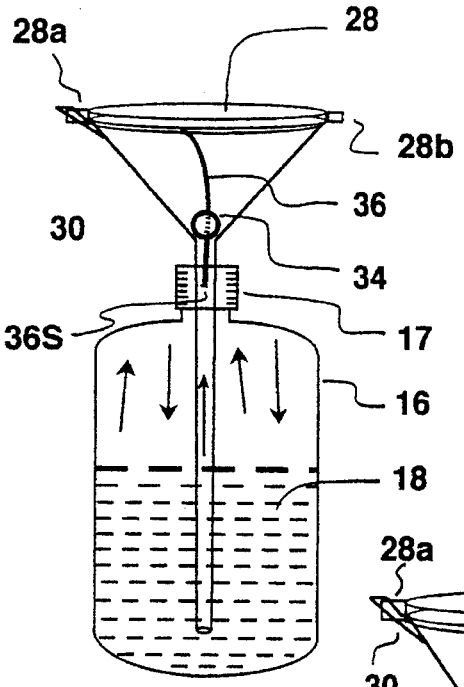
FIGS. 3A to 3C are similar views of the carboy with an ecological cap-operated funnel in accordance with the invention.
Figure 3B:
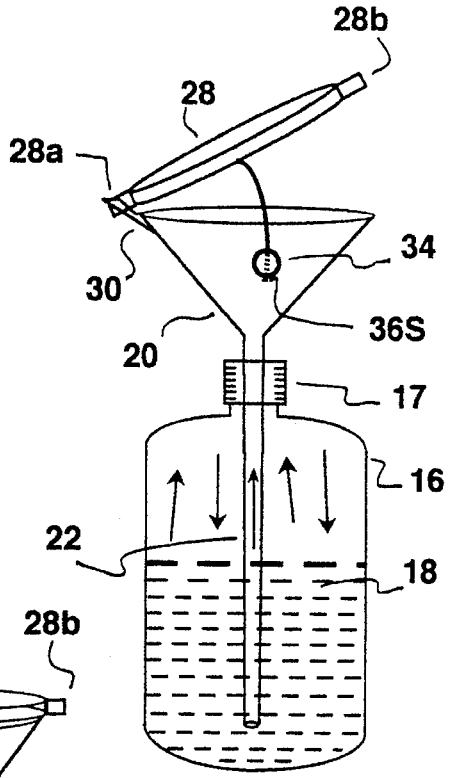
Figure 3C:
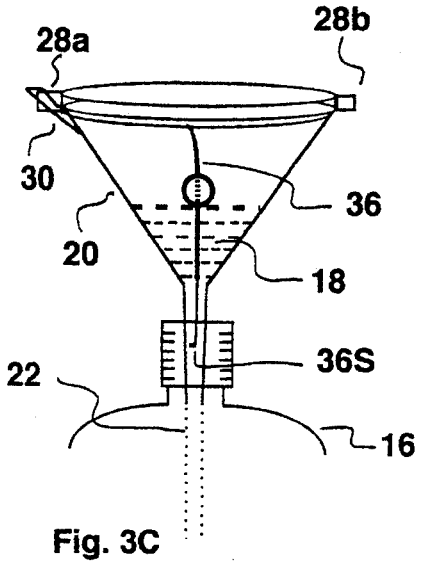

FIGS. 3A To 3C—Lid-Operated Obturator Ball

In lieu of a self-operating floating ball, the ball can be lid operated, as shown in FIG. 3. In this embodiment, funnel 20, carboy 16, lid 28, and bracket 30 are the same as in FIG. 2. The obturating ball, here designated 34, is again made less dense than solvent 18 and is connected to lid 28 by a stainless steel flat rigid link 36. The upper end of link 36 is attached to the center of the underside of lid 28, e.g., by riveting a folded section (not shown) at the top of the link. The link extends through a hole or slot in the ball without much play in order to prevent evaporation of solvent vapor through such hole. The lower end of the link has a stop 36S to captivate the ball to prevent it from falling off the link. The ball normally sits in the throat of the funnel (FIG. 3A), thereby obturating such throat as in FIG. 3A and preventing the escape of solvent vapors. The lower end of the link extends slightly below the ball (by about 1 cm) into neck 22 of the funnel.

The embodiment of FIG. 3 operates as follows: To empty solvent into the carboy, a worker lifts lid 28, as shown in FIG. 3B, as in the previous embodiment. When the lid is so lifted, it will pull up link 36 and stop 36S at the lower end of the link. The link will slide up through the hole in the ball until the ball meets stop 36S at the bottom of the link. The stop will in turn pull up ball 34, as indicated in FIG. 3B. This will lift the ball out of the throat of the funnel, causing such throat to become patent, allowing the solvent (not shown) to flow into the carboy.

When the worker is done, the worker closes the lid. This lowers link 36 and allows ball 34 to fall back into the throat of the funnel into the obturating position, as shown in FIG. 3A. Thereby the funnel will not be able to emit solvent vapors between solvent dumps thereinto.

If the worker closes the lid before all of the solvent falls into the carboy, the link will move down with the lid. However the ball, being less dense than the solvent, will be floated by the solvent so that the ball will stay on the surface of the solvent as shown in FIG. 3C. The link will thus move down through the hole in the ball. Since the ball stays on the surface, it will not move down into its obturating position in neck 22. As the level of the solvent is lowered as the solvent falls into the carboy, the ball will move down on the link until all of the solvent falls into the carboy and the ball rests in its obturating position in the neck of the funnel, as shown in FIG. 3A.

Alternatively the bottom end of link 36 can be rigidly attached to the ball, whereupon the ball will move with the link when the lid is raised or lowered. When the lid is re-lowered, it will push ball 34 back into the throat, guided by the converging sides of the funnel's body. In this case, ball 34 can be made denser than solvent 18. E.g., the ball may have a metal core or it can be made of a dense plastic.

As another alternative, ball 34 can be made denser than solvent 18 and link 36 preferably is flexible, e.g., of nylon, such as fish line, but also can be made of a metal chain, a semi-rigid link, a cord, e.g., of woven plastic, etc. The top of the link can be attached to the underside of the lid by cementing, knotting around a molded grommet (not shown) in the lid. The lower end of the link is attached to the ball by cement, embedding the end into the ball, or by a grommet on the ball and a knot in the link (not shown) etc. Now, when the lid is lifted, it will pull up the flexible link which will in turn pull up the ball. When the lid is lowered, the weight of the ball will cause it to fall into its obturating position in stem 22.

FIGS. 4—Foot-Pedal Operated Lid Obturator Ball

The embodiment of FIGS. 4 is similar to that of FIG. 3, except that a foot pedal is provided to operate the lid so that the worker will not have to lift it manually, thereby leaving the hands free to dump the solvent into the funnel.

Figure 4A:
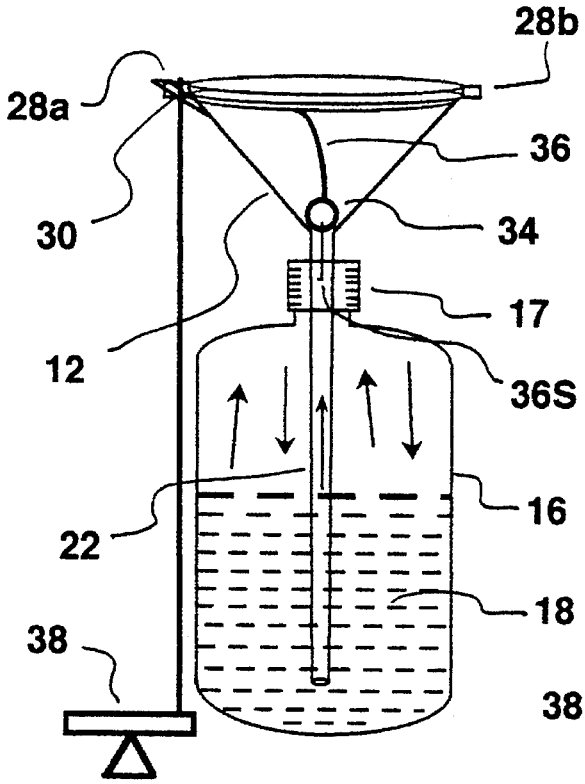
FIGS. 4A and 4B are views of the carboy with an ecological funnel and a foot-operated cap opener, in occluding and transmissive conditions, in accordance with the invention.
Figure 4B:
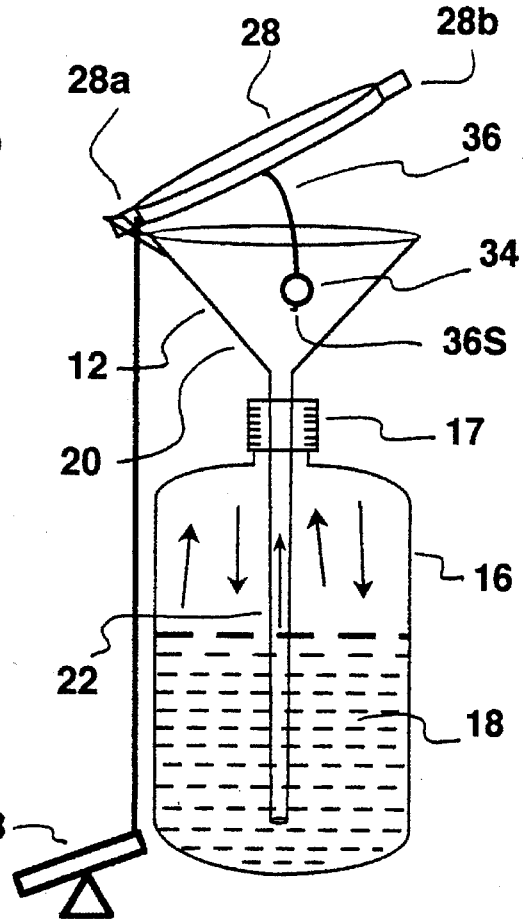

The pedal mechanism comprises a fulcrum or pivot mounted foot pedal 38, similar to the type used on trash cans with pedal-operated lids. Pedal 38 and its fulcrum are connected to carboy 16 or a base or stand therefor (not shown). A link 40 connects foot pedal 38 to arm 28*a* of lid 28 so that when a worker steps onto the left end of pedal 38 in FIG. 4A, the fight end thereof will picot upwardly and raise lid 28, as shown in FIG. 4B. Thus the worker is now free to dump solvent into the funnel, where it will fall into the carboy since ball 34 is removed from the throat of the funnel by the lifting of lid 28, as in FIG. 3.

A more complex linkage may be provided so that the pedal and the open side of lid 28 are on the same side of the carboy.

When the worker is finished dumping the solvent into the funnel, the worker removes the foot from pedal 38 and gravity returns the lid to seal the top of the funnel. The pedal mechanism prevents the lid from opening more than 90° to the plane of the top edge of the funnel, so that gravity will always return the lid when the worker releases the foot pedal.

FIG. 5—Brackets

Figure 5C:
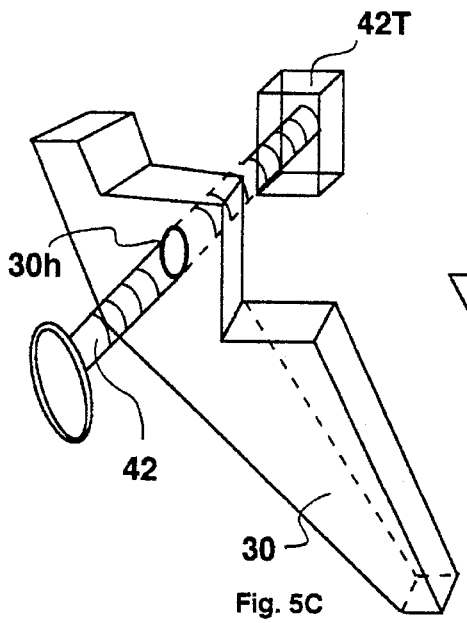
FIG. 5C is a perspective view of such a bracket with a timer box in accordance with the invention.

FIG. 5 shows details of bracket 30 which is used to hingedly connect lid 28 to the side of body 12 of the funnel.

Figure 5B:
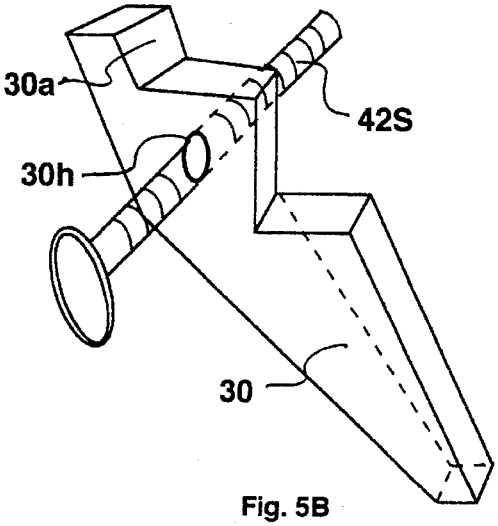
FIGS. 5A and 5B are side and perspective views of a bracket and spring hinge for use with a lid of the funnels of the invention.
Figure 5A:
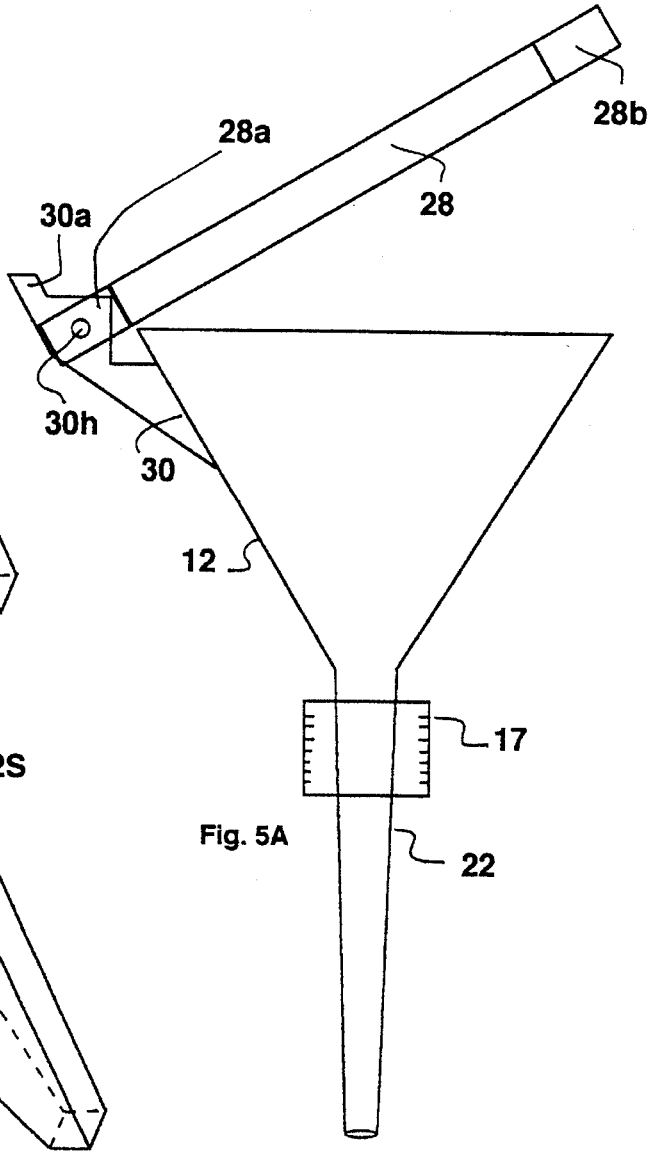

FIG. 5A shows a side view which details the shape of the bracket and its connection to body 12 and arm 28*a*. Bracket 30 has an upward extension tab 30*a* which prevents lid 28 from being opened past 90° as aforenoted so that it will always return to cover the funnel, in the embodiment of FIG. 3, and in FIG. 4 even if the foot pedal mechanism is disconnected. The bracket has a through hole 30*h* through which a hinge pin or pintle (FIG. 5B)

The perspective view of FIG. 5B details a hinge pin or pintle 42 which passes through arm 28*a* (not shown) and hole 30*h*. Pin 42 may have a coil spring 42*s* wound therearound to return lid 28 to its closed position when the worker releases the lid.

Alternatively, pin 42 may be connected to a mechanical timer mechanism 42*t* which allows lid 28 to remain open for a short interval, say 15 seconds, and then closes the lid automatically and gradually after the interval. Optionally timer 42*t* may play music during the interval when the lid is open. In lieu of timer 42*t*, the lid may contain a viscous-fluid self closing timer, as shown in U.S. Pat. No. 4,205,483 to Clark and Pressman (1980), or it may contain a miniaturized egg timer.

Summary, Ramifications, and Scope

Accordingly the reader will see that, according to the invention, we have provided a funnel which virtually eliminates atmospheric contamination from evaporated solvents, precludes the need for personnel to recap such funnels after use, to provide an ecologically friendly funnel, and to reduce the incidence of cancer and other deleterious effects (smog, haze, unbluing of the sky, asthmatic effects, destruction of the protective ozone layer, etc.) from solvent evaporation.

While the above description contains many specificities, these should not be construed as limitations on the scope of the invention, but as exemplifications of the presently preferred embodiments thereof. Many other ramifications and variations are possible within the teachings of the invention. For example, the funnel need not have a circular configuration when seen from the top, but can be oval, rectangular, triangular, etc. The materials recommended for the various parts shown may be varied, so long as they are compatible with the solvents used. The funnel need not be used with a carboy, but can be used with any other disposal receiver or system, including a drumlike receiver. The lid, the long stem of the funnel, and/or the obturating ball may be eliminated, at some loss of solvent vapor retention. A separate seal may be provided between the neck of the carboy and the outside of the stem of the funnel. The body of the funnel can have generally parallel sides with a tapered bottom and the stem of the funnel need not be tapered. In lieu of a spherical ball, a tapered conical plug or a semispherical obturator, weighted on one side, can be used. In lieu of a step-on foot pedal, an electronic (e.g., infra-red) detector which detects the approach of a worker can be used to open the lid automatically. In the embodiment of FIGS. 4A and 4B, the lid need not be hinged, but can be loose or attached to the funnel in a different way.

Thus the scope of the invention should be determined by the appended claims and their legal equivalents, and not by the examples given.

We claim:

1. A self-sealing ecological funnel apparatus which prevents backflow of solvent vapors, comprising:

a funnel having a conical, tapered body portion having a relatively wide open upper end and a relatively narrow bottom end, said funnel having a stem having an upper end attached to and extending downwardly from said bottom end of said body portion, and an open bottom end, said stem having a lumen of a predetermined size at said upper end thereof, an obturating ball positioned in said body portion, said ball having a size larger than said predetermined size of said lumen so that said ball will obturate but will not enter said lumen, said obturating ball having a density less than a predetermined value such that said ball will float on any liquid having a density greater than said predetermined value which is poured into said lumen, and a captivating cage in said body portion of said funnel, said cage surrounding an area above said obturating ball and being large enough to allow said ball to move upwardly from said lumen to allow any fluid poured into said body portion to flow into said lumen.

2. A self-sealing ecological funnel apparatus which prevents backflow of solvent vapors, comprising:

a funnel having a conical, tapered body portion having a relatively wide open upper end and a relatively narrow bottom end, said funnel having a stem having an upper end attached to and extending downwardly from said bottom end of said body portion, and an open bottom end, said stem having a lumen of a predetermined size at said upper end thereof, an obturating ball positioned in said body portion, said ball having a size larger than said predetermined size of said lumen so that said ball will obturate but will not enter said lumen, and a closure cap attached to said stem of said funnel, said closure cap being arranged to sealingly mate with the neck of a predetermined carboy so that said closure will seal the area between stem and said neck when said stem is inserted into said neck, said closure cap having internal threads thereon for mating with external threads on said neck of said carboy.

3. A self-sealing ecological funnel apparatus which prevents backflow of solvent vapors, comprising:

a funnel having a conical, tapered body portion having a relatively wide open upper end and a relatively narrow bottom end, said funnel having a stem having an upper end attached to and extending downwardly from said bottom end of said body portion, and an open bottom end, said stem having a lumen of a predetermined size at said upper end thereof, an obturating ball positioned in said body portion, said ball having a size larger than said predetermined size of said lumen so that said ball will obturate but will not enter said lumen, and said ball having a density less than a predetermined value such that said ball will float on any liquid having a density greater than said predetermined value which is poured into said lumen, said stem being sufficiently elongated to extend throughout the major portion of the height of a carboy of a predetermined size and close to the bottom of said carboy, such that said bottom end of said stem will be submerged in liquid if a predetermined small quantity of liquid is in said carboy, and a closure cap attached to said stem, said closure cap being arranged to sealingly mate with the neck of a predetermined carboy so that said closure will seal said stem to said neck when said stem is inserted into said neck.

* * * * *